US007577380B2

(12) United States Patent
Mori

(10) Patent No.: US 7,577,380 B2
(45) Date of Patent: Aug. 18, 2009

(54) IMAGE FORMING APPARATUS INCLUDING A BELT UNIT

(75) Inventor: Hirotaka Mori, Ichinomiya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 408 days.

(21) Appl. No.: 11/564,029

(22) Filed: Nov. 28, 2006

(65) Prior Publication Data

US 2007/0147891 A1 Jun. 28, 2007

(30) Foreign Application Priority Data

Dec. 27, 2005 (JP) ..... 2005-374704

(51) Int. Cl.
*G03G 15/16* (2006.01)

(52) U.S. Cl. ..... 399/121

(58) Field of Classification Search ..... 399/121, 399/302, 303

See application file for complete search history.

(56) References Cited

U.S. PATENT DOCUMENTS 6,522,848 B2 * 2/2003 Wakana ..... 399/121
7,369,793 B2 * 5/2008 Kumazawa ..... 399/121
7,454,158 B2 * 11/2008 Nakano et al. ..... 399/121

FOREIGN PATENT DOCUMENTS

JP 2002193471 7/2002

* cited by examiner

*Primary Examiner*—William J Royer
(74) *Attorney, Agent, or Firm*—Banner & Witcoff, Ltd.

(57) ABSTRACT

A belt driven roller having a belt guide that positions a conveying belt in a width direction is supported in an axial direction relative to a belt frame, and positioned in the axial direction relative to a body casing. This can increases positional accuracy of the conveying belt relative to the body casing in the width direction. The belt driven roller is displaceable in the axial direction relative to the belt frame, and even if the belt driven roller and a belt driving roller are positioned in the axial direction relative to the body casing, dimensional tolerance between the belt driven roller and the belt driving roller reduces or eliminates distortion in the belt frame. This can increase positional accuracy of transfer rollers and results in a more stable image quality.

12 Claims, 7 Drawing Sheets

IMAGE FORMING APPARATUS INCLUDING A BELT UNIT

CROSS REFERENCE TO RELATED APPLICATION

This application claims priority from Japanese Patent Application No. 2005-374704 filed Dec. 27, 2005. The entire content of this priority application is incorporated herein by reference.

TECHNICAL FIELD

The present invention relates to an image forming apparatus.

BACKGROUND

A known image forming apparatus, such as a color laser printer, may include a belt unit having a belt for conveying paper or intermediate transfer. The belt unit may include, for example, a belt driving roller rotatably driven and a belt driven roller rotated in a driven manner, both of which being supported by a synthetic resin belt frame. The belt unit belt is extended between the rollers. The belt driven roller has belt guides at both ends, and protrusions (guide ribs) provided at side ends of an inner surface of the belt, the protrusions engaging the belt guides to position the belt in a width direction. The belt frame supports a plurality of transfer rollers for transfer of a developer image to recording medium, and the transfer rollers are placed to face, via the belt, a plurality of photosensitive drums supported by a body frame in an apparatus body.

Such a belt unit is, for example, urged in an axial direction of the belt driving roller (the width direction of the belt) by driving a gear (helical gear) connected to the belt driving roller when mounted in the apparatus body, and an end of a shaft of the belt driving roller is abutted against the body frame in the apparatus body to position the entire belt unit in the width direction of the belt.

In such an image forming apparatus, relative positional accuracy of each photosensitive drum and each transfer roller and paper needs to be ensured for obtaining stable image quality without color shift. Thus, the belt for conveying paper requires positional accuracy relative to each photosensitive drum. However, in the above configuration, the belt is positioned in the width direction relative to the body frame via many components (such as the belt driven roller, the belt frame, and the belt driving roller), and positional accuracy in the width direction is hard to ensure.

Thus, there is a need in the art for an image forming apparatus that allows positional accuracy of a belt to be ensured and allows stable image quality to be obtained.

SUMMARY

An image forming apparatus includes an apparatus body, and a belt unit detachably attached to said apparatus body, wherein said belt unit includes a belt having an engaging portion, a belt frame, a belt driving roller that is positioned and supported by the belt frame, wherein the belt driving roller contacts the belt and is capable of being driven to move said belt, a belt driven roller that is supported by the belt frame, the belt driven roller contacts the belt, wherein the belt driven roller includes a belt guide that contacts said engaging portion to position said belt in a width direction, and is rotated by movement of said belt, wherein said apparatus body includes a driving roller axial positioning portion that positions said belt driving roller in the axial direction, and a driven roller axial positioning portion that positions said belt driven roller in the axial direction.

According to the configuration, the belt driven roller is directly positioned relative to the apparatus body, thereby increasing positional accuracy of the belt in the width direction relative to the apparatus body. Even when the belt driven roller and the belt driving roller are positioned in the axial direction relative to the apparatus body, dimensional tolerance between the belt driven roller and the belt driving roller reduces or eliminates distortion in the belt frame positioned integrally with the belt driving roller. This can also increase the positional accuracy of a transfer member and result in a more stable image quality.

BRIEF DESCRIPTION OF THE DRAWINGS

Illustrative aspects in accordance with the invention will be described in detail with reference to the following figures wherein.

DETAILED DESCRIPTION OF THE PREFERRED ILLUSTRATIVE ASPECTS

Now, one aspect of the present invention will be described with reference to FIGS. 1 to 7.

Figure 1:
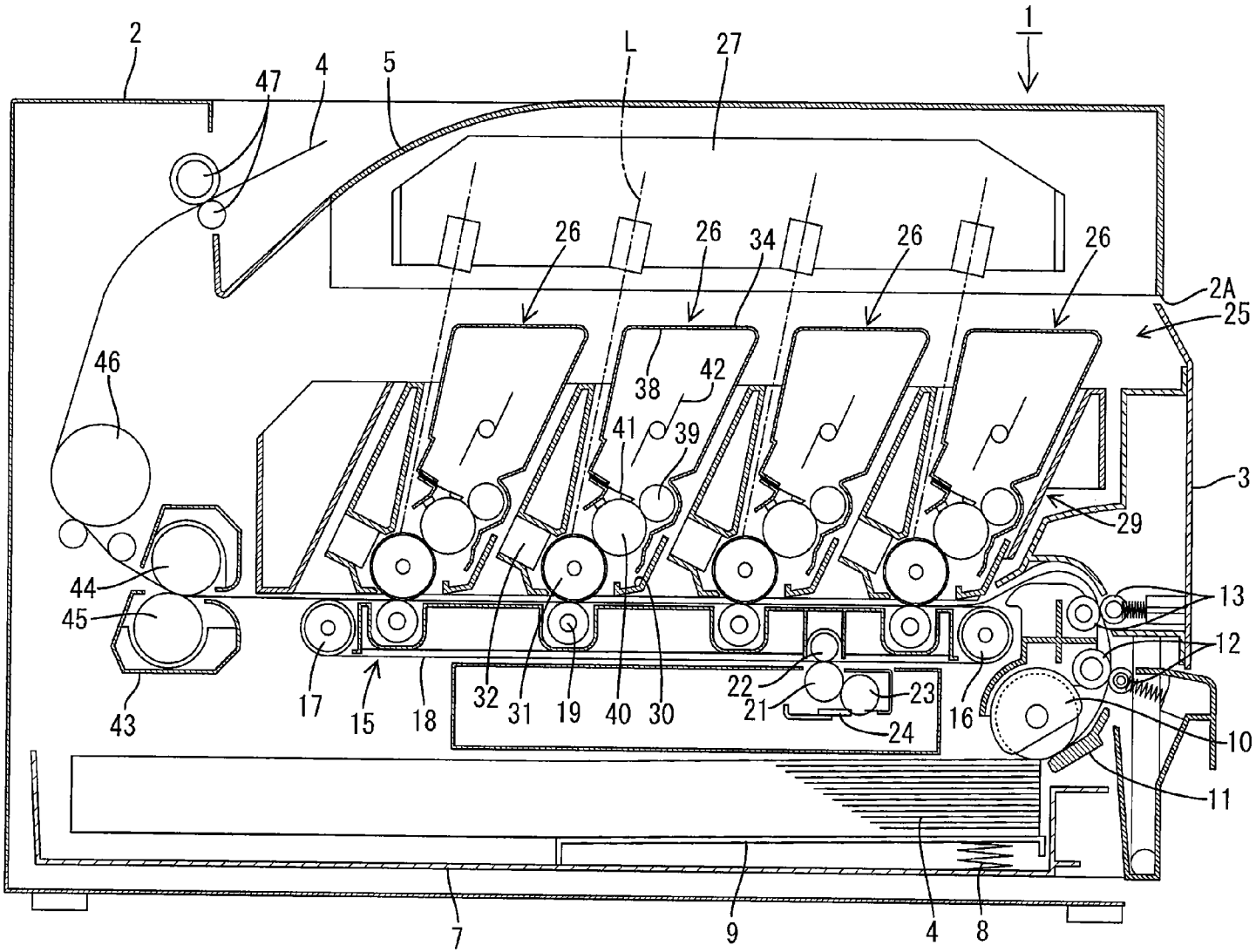
FIG. 1 is a side sectional view of a schematic configuration of an image forming apparatus according to one aspect of the present invention.
Figure 2:
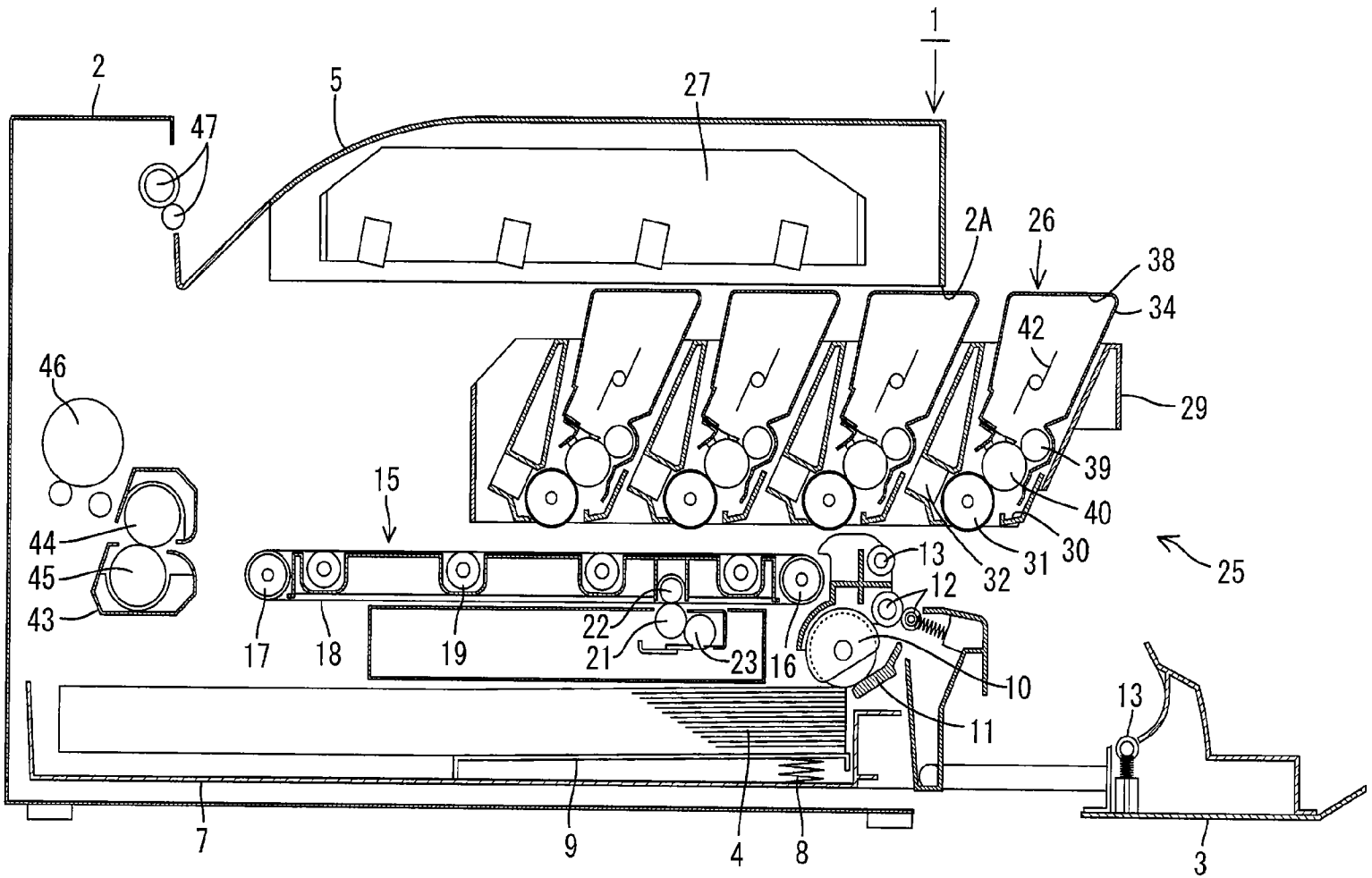
FIG. 2 is a side sectional view of the image forming apparatus similar to FIG. 1.

FIG. 1 is a side sectional view of a schematic configuration of an image forming apparatus 1 according to one aspect of the present invention, and FIG. 2 is a side sectional view of the image forming apparatus 1 in the course of moving a process portion 25. In the description below, the right side in FIG. 1 shows the front.

The image forming apparatus 1 can be a laser printer, or more specifically can be a direct transfer tandem type color laser printer. The image forming apparatus 1 includes a substantially box-shaped body casing 2 as shown in FIG. 1, and an attachment and detachment opening 2A which can be covered with an openable and closable front cover 3. The front cover 3 can be opened to allow the process portion 25 to be moved forward from the body casing 2 through the attachment and detachment opening 2A as shown in FIG. 2. An output tray 5 that receives recording medium 4 after image formation can be formed on an upper surface of the body casing 2. Recording medium 4 can include, but is not limited to, paper and the like.

A feed tray 7 that receives recording medium 4 for image formation is mounted to a lower portion of the body casing 2 so as to be moveable forward. A pressure plate 9 tiltable to raise a front end of the recording medium 4, by urging a spring 8, is provided in the feed tray 7. Above a front end of the feed tray 7, a pickup roller 10 and a separation pad 11 are provided. The separation pad 11 is urged to abut against the pickup roller 10 by a spring (not shown). Further, a pair of feed rollers 12 are provided obliquely upward on the front of the pickup roller 10, and a pair of registration rollers 13 are provided above the feed rollers 12.

In the uppermost position of the feed tray 7, recording medium 4 is pressed toward the pickup roller 10 by the pressure plate 9, and the recording medium 4 is separated one by one (or more when there is a plurality) when held between the pickup roller 10 and the separation pad 11 by rotation of the pickup roller 10. The recording medium 4 fed from between the pickup roller 10 and the separation pad 11 is fed to the registration rollers 13 by the paper feed rollers 12. The registration rollers 13 feed the recording medium 4 onto a belt unit 15 at a predetermined time.

The belt unit 15 is detachably attached to the body casing 2, and has a conveying belt 18 horizontally extended between a belt driven roller 16 and a belt driving roller 17 spaced apart at the front and the rear. The conveying belt 18 can be a belt made of resin such as polycarbonate adapted to function as a transfer belt, and circulatingly moved counterclockwise (in FIG. 1) by rotatably driving the belt driving roller 17 to convey recording medium 4 thereon. Inside the conveying belt 18, transfer rollers 19 positioned to face photosensitive drums 31 of an image forming unit 26 (described later) The transfer rollers 19 are provided in line at regular intervals in a direction from the front to the rear, and the conveying belt 18 is sandwiched between the photosensitive drums 31 and the corresponding transfer rollers 19. Each transfer roller 19 can be formed by covering a metal roller shaft with an elastic member such as conductive rubber, and a transfer bias is applied between the transfer roller 19 and the photosensitive drum 31 in transfer. A positioning structure of the belt unit 15 will be described later in detail.

A cleaning roller 21 for removing toner or paper powder adhering to the conveying belt 18 can be provided in a lower side of the belt unit 15. The cleaning roller 21, which can be formed by providing foamed material of silicone around a metal shaft member, faces a metal backup roller 22 provided in the belt unit 15 via the conveying belt 18. A predetermined bias is applied between the cleaning roller 21 and the backup roller 22, and thus toner on the conveying belt 18 is removed by the cleaning roller 21 and electrically sucked toward the cleaning roller 21. A metal collecting roller 23 for removing toner adhering to a surface of the cleaning roller 21 abuts against the cleaning roller 21, and a blade 24 for removing toner adhering to a surface of the collecting roller 23 abuts against the collecting roller 23.

A scanner portion 27 is provided in an upper portion in the body casing 2, the process portion 25 is provided below the scanner portion 27, and the belt unit 15 is placed below the process portion 25.

The scanner portion 27 emits a laser light L of multiple colors, based on predetermined image data, onto a surface of a corresponding photosensitive drum 31 by high speed scanning.

The process portion 25 can include four image forming units 26 corresponding to colors of magenta, yellow, cyan and black, and the image forming unit(s) 26 are placed in line in the direction from the front to the rear. Each image forming unit 26 includes the photosensitive drum 31 as an image bearing member, a charger 32 (i.e. a scorotron type), and a developing cartridge 34 as a developing device. The process portion 25 includes a process frame 29 having cartridge mounting portions 30 arranged in line in the direction from the front to the rear. The developing cartridge 34 is mounted to each cartridge mounting portion 30 so that each developing cartridge 34 is detachably attached to the cartridge mounting portion 30 with the process frame 29 moveable forward from the attachment and detachment opening 2A. In the process frame 29, the photosensitive drum 31 of each image forming unit 26 is held in a lower end position of each cartridge mounting portion 30, and the charger 32 is held adjacent to the photosensitive drum 31. The process frame 29constitutes a drum unit (an image bearing member unit) including the plurality of photosensitive drums 31.

The photosensitive drum 31 can include a grounded metal drum body, and can be formed by covering a surface of the drum body with a positively chargeable photosensitive layer such as of polycarbonate.

The charger 32 is placed obliquely upward on the rear of the photosensitive drum 31 to face the photosensitive drum 31 with a predetermined space so as not to come into contact with the photosensitive drum 31. The charger 32 generates corona discharge from a charging wire (not shown) such as of tungsten to positively charge the surface of the photosensitive drum 31 uniformly.

The developing cartridge 34 includes a toner accommodating chamber 38 in an upper portion therein, a supply roller 39, a developing roller 40 and a layer thickness control blade 41. Each toner accommodating chamber 38 accommodates toner of one nonmagnetic component positively charged plurality of colors (i.e. yellow, magenta, cyan and black) as a developer. Each toner accommodating chamber 38 includes an agitator 42 for agitating the toner.

The supply roller 39 can include a metal roller shaft covered with conductive foam material, and the developing roller 40 can include a metal roller shaft covered with conductive rubber material. The toner discharged from the toner accommodating chamber 38 is supplied to the developing roller 40 by rotation of the supply roller 39, and is frictionally charged positively between the supply roller 39 and the developing roller 40. Further, the toner supplied onto the developing roller 40 enters between the layer thickness control blade 41 and the developing roller 40 with rotation of the developing roller 40, and is further frictionally charged and carried on the developing roller 40 as a thin layer having a predetermined thickness.

The surface of the photosensitive drum 31 is positively charged uniformly by the charger 32 during rotation of the photosensitive drum 31. Then, the surface is exposed to light by the high speed scanning of the laser light L from the scanner portion 27 to form an electrostatic latent image corresponding to an image to be formed on the recording medium 4.

Then, by the rotation of the developing roller 40, the toner carried on the developing roller 40 and positively charged is supplied to the electrostatic latent image formed on the surface of the photosensitive drum 31. Thus, the electrostatic latent image on the photosensitive drum 31 is visualized, and the surface of the photosensitive drum 31 carries a toner image with the toner adhering to exposed portions only.

Then, toner images carried on the surfaces of the photosensitive drums 31 are successively transferred to recording medium 4 by a transfer bias having a negative polarity applied to the transfer rollers 19 while the recording medium 4, conveyed by the conveying belt 18, passes each transfer position between the photosensitive drums 31 and the transfer rollers 19. Thus, the recording medium 4, with the toner images transferred, is then conveyed to a fixing device 43.

The fixing device 43 is placed on the rear side of the conveying belt 18 in the body casing 2. The fixing device 43 includes a heating roller 44 having a heat source such as a halogen lamp which is rotatably driven. The fixing device 43 also includes a press roller 45 placed below the heating roller 44 to face the heating roller 44 so as to press the heating roller 44. In the fixing device 43, the recording medium 4 carrying the toner image with the plurality of colors is heated while being held between the heating roller 44 and the press roller 45 and conveyed to fix the toner image on the recording medium 4. The recording medium 4 subjected to the heat fixing is conveyed to a paper output roller pair 47 provided in an upper portion of the body casing 2 by a conveying roller 46 placed obliquely upward on the rear side of the fixing device 43, and output onto the paper output tray 5 by the paper output roller pair 47.

Next, the positioning structure of the belt unit 15 will be described.

Figure 3:
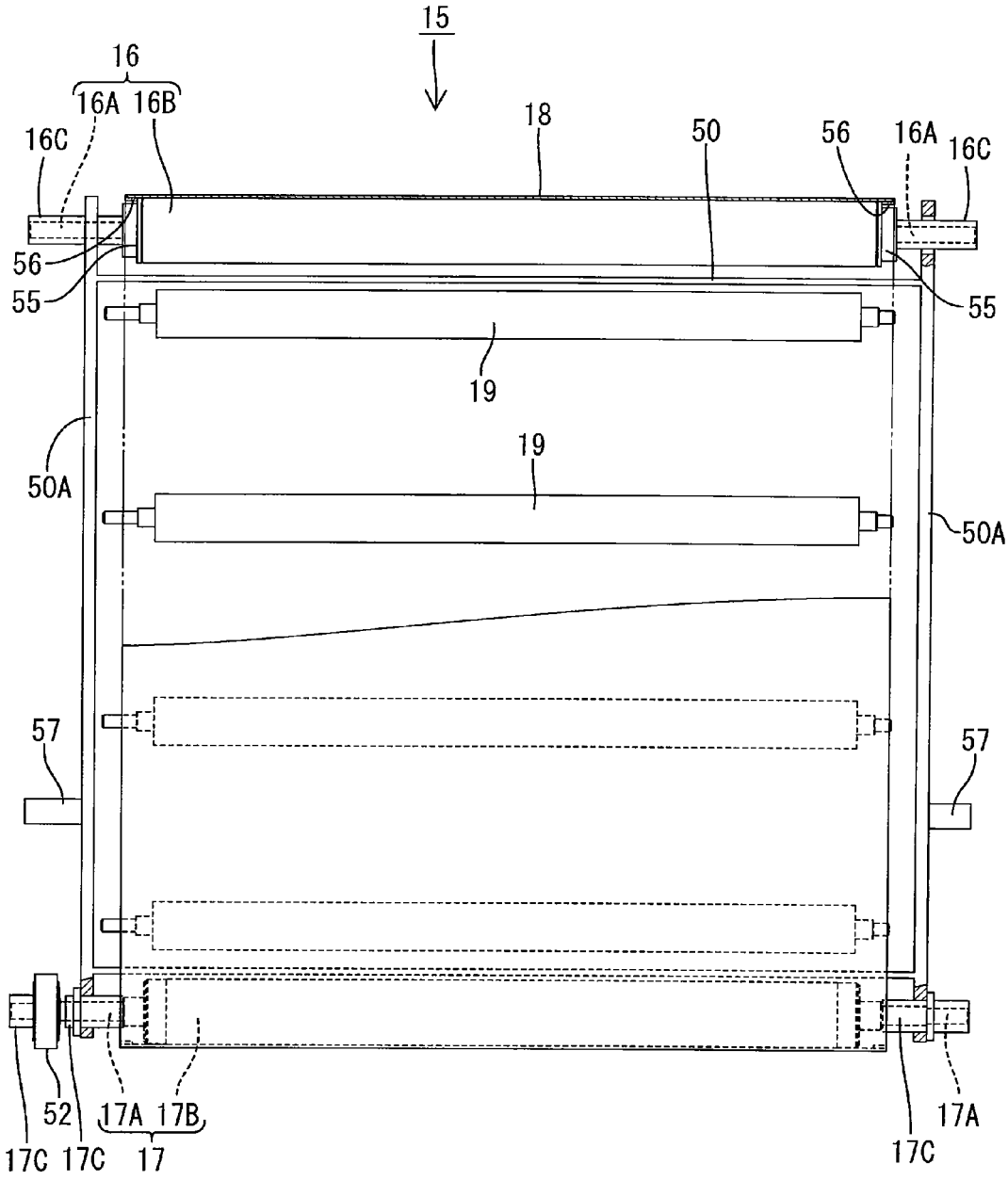
FIG. 3 is a plan view, partially broken away, of a belt unit.
Figure 4:
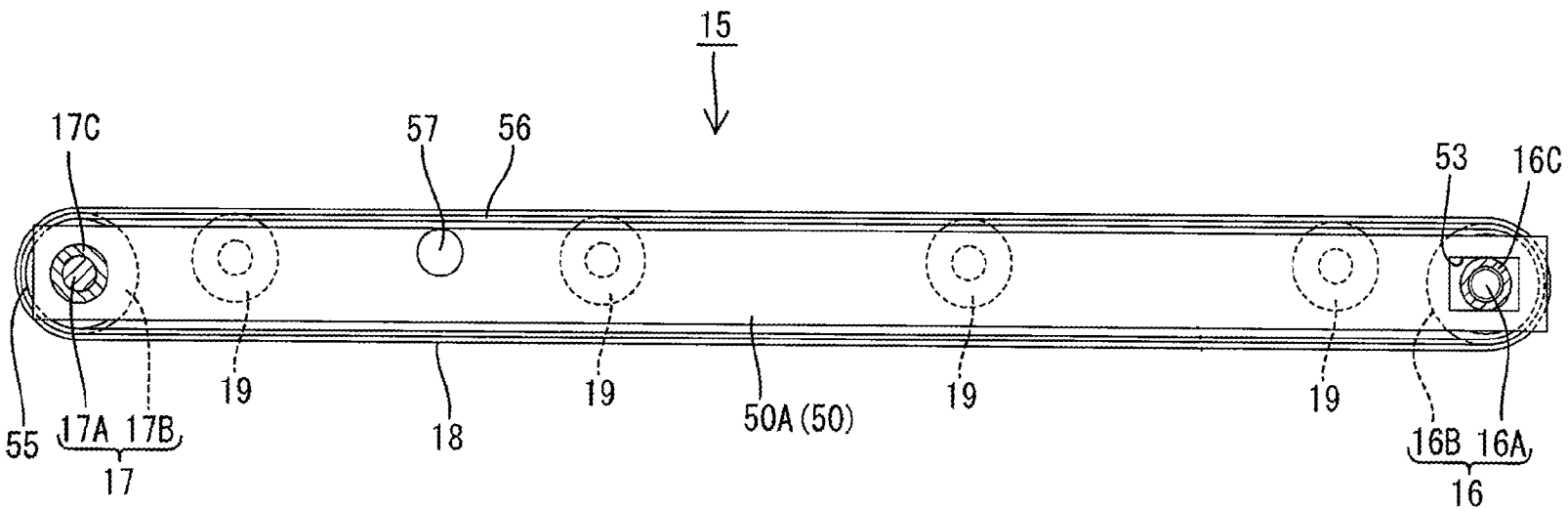
FIG. 4 is a side view of the belt unit.
Figure 5:
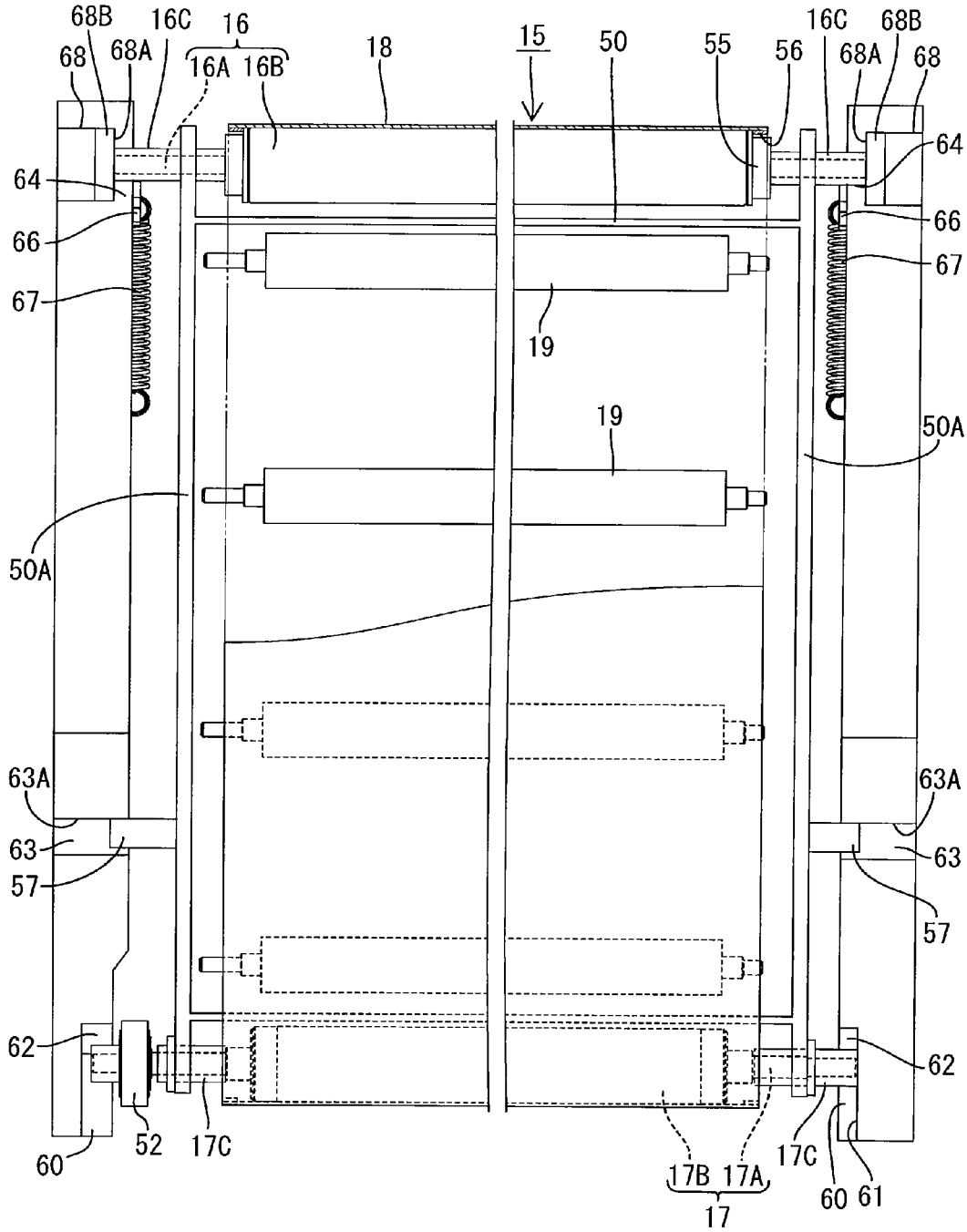
FIG. 5 is a plan view, partially broken away, of the belt unit positioned in a body casing.
Figure 6:
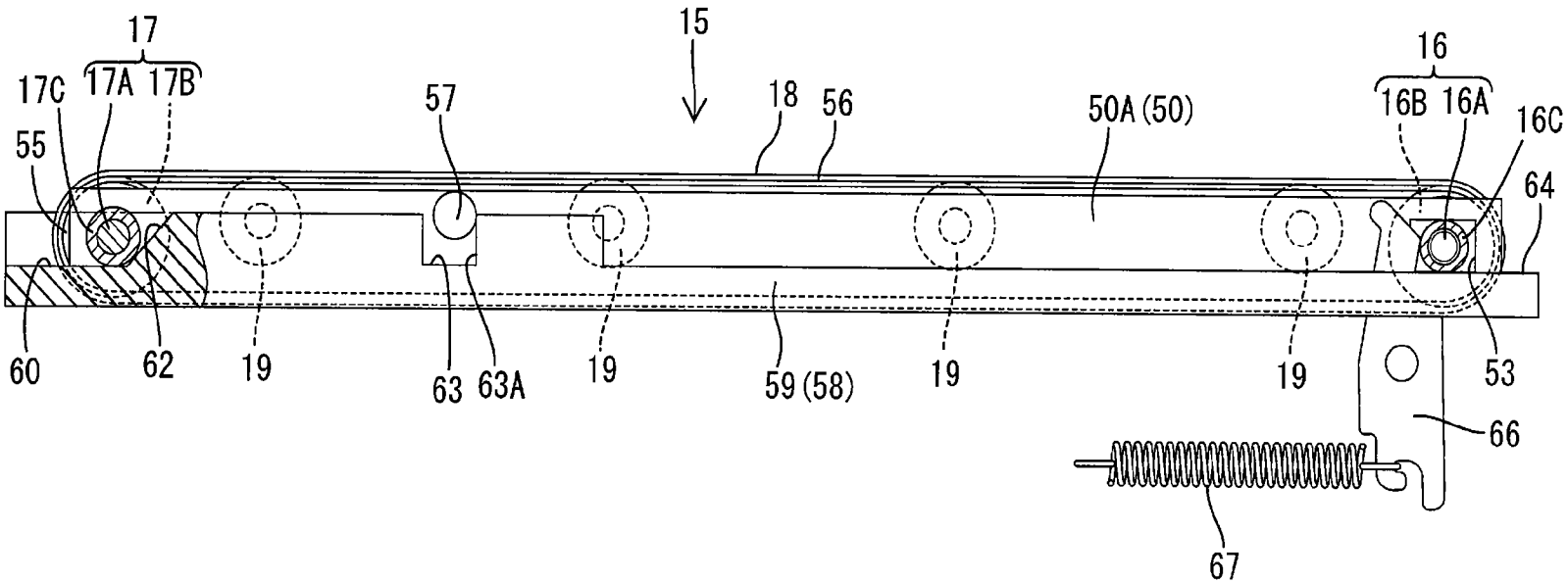
FIG. 6 is a side view, partially broken away, of the belt unit positioned in the body casing.
Figure 7:
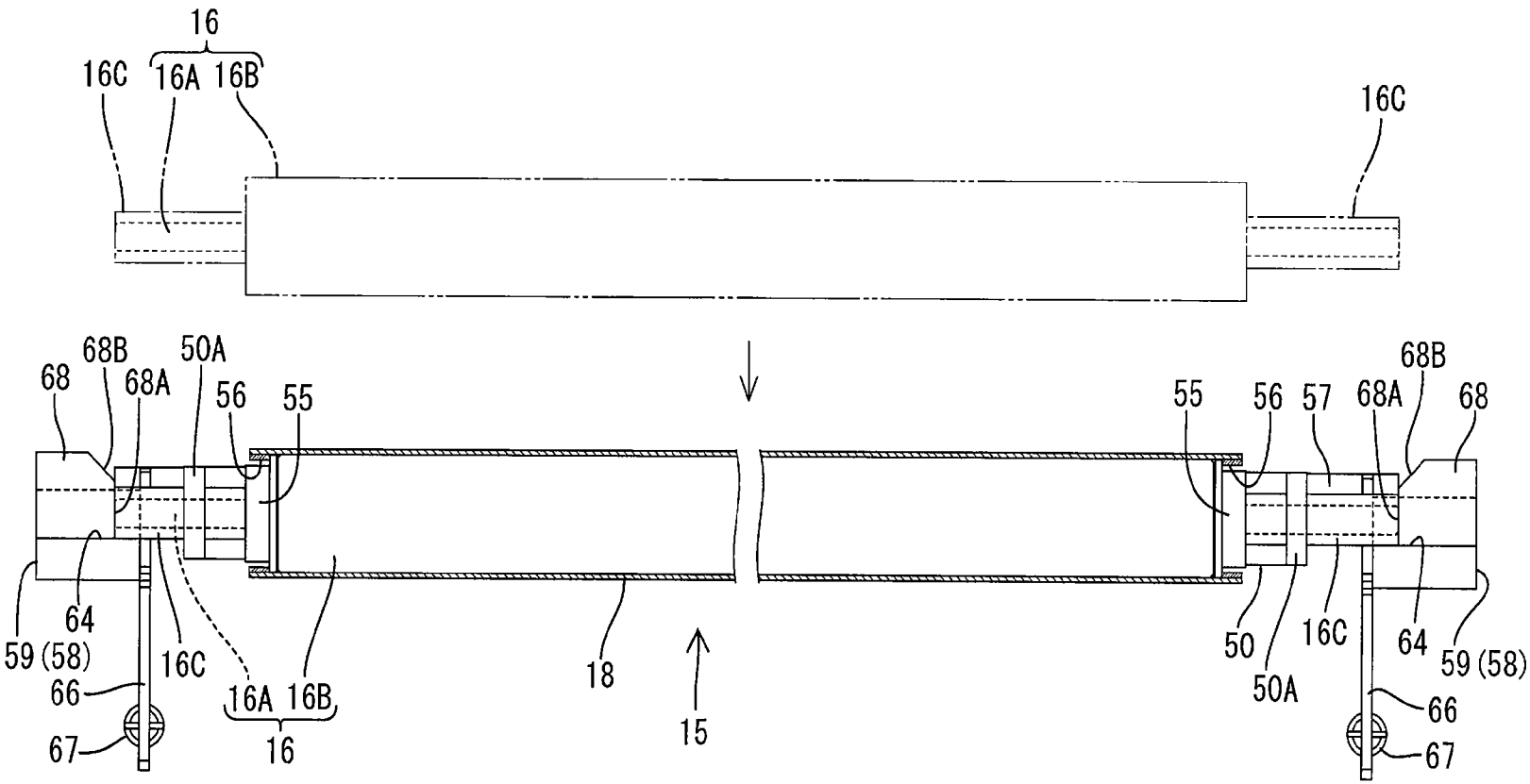
FIG. 7 is a front view, partially broken away, of the belt unit positioned in the body casing.

FIG. 3 is a plan view, partially broken away, of a schematic configuration of the belt unit 15, FIG. 4 is a side view thereof, FIG. 5 is a plan view, partially broken away, of the belt unit 15 positioned in the body casing 2, FIG. 6 is a side view thereof, and FIG. 7 is a front view thereof.

As shown in FIGS. 3 and 4, the belt unit 15 includes a belt frame 50, which can be constructed of synthetic resin. The belt frame 50 is generally of a rectangular plate shape, and has a pair of right and left side walls 50A. The belt driving roller 17 can be formed by covering a surface of a roller body 17B made of a substantially cylindrical metal tube of aluminum or stainless with a rubber layer or a coating layer for ensuring a gripping force with an inner surface of the conveying belt 18. Further, both ends of a roller shaft 17A extended from right and left ends of the roller body 17B and are rotatably supported by shaft receiving portions 17C mounted to rear ends of the side walls 50A of the belt frame 50. The roller shaft 17A of the belt driving roller 17 is supported in the axial direction and a radial direction via the shaft receiving portion 17C mounted to the belt frame 50. Specifically, the belt driving roller 17 can be positioned in a lateral direction (the width direction of the conveying belt 18), a direction from the front to the back, and a vertical direction relative to the belt frame 50. Also, a connection gear 52 (which can be a helical gear) is provided at a left end in FIG. 3 of the roller shaft 17A of the belt driving roller 17. The connection gear 52 is connected to an output gear (which can be a helical gear) provided in a gear mechanism (not shown) in the body casing 2. When the belt unit 15 is mounted to the body casing 2, and power of a main motor (not shown—also in the body casing 2) is input via the connection gear 52, the belt driving roller 17 is driven and thereby circulatingly moves the conveying belt 18.

The belt driven roller 16 can be formed by plating a surface of a roller body 16B made of a substantially cylindrical metal tube of aluminum, stainless steel, or the like, for preventing friction of the surface caused by friction with the inner surface of the conveying belt 18. Further, a roller shaft 16A extends from right and left ends of the roller body 16B. As shown in FIG. 4, bearing holes 53 are provided in front ends of the side walls 50A of the belt frame 50. Further, shaft receiving portions 16C, that rotatably support the roller shaft 16A, are inserted through the bearing holes 53 to rotatably support the belt driven roller 16 around the roller shaft 16A. The shaft receiving portions 16C are displaceable in the direction from the front to the back in the bearing holes 53, and the roller body 16B is supported in the vertical direction and displaceably in the axial direction (the width direction of the conveying belt 18) relative to the belt frame 50. Specifically, the belt driven roller 16 is positioned in the vertical direction relative to the belt frame 50.

Belt guides 55, recessed to form steps, are provided in right and left ends of the roller body 16B of the belt driven roller 16. Engaging portions 56 are provided in a protruding manner over the circumference in right and left ends of the inner peripheral surface of the conveying belt 18, and each engaging portion 56 engages the belt guide 55 to position the conveying belt 18 in the width direction (the lateral direction) relative to the belt driven roller 16.

In the belt frame 50, the transfer rollers 19 are provided at regular intervals in the direction from the front to the back between the belt driven roller 16 and the belt driving roller 17, and a backup roller 22 is provided on a lower side. The transfer rollers 19 and the backup roller 22 are positioned in the axial direction and in the direction from the front to the back relative to the belt frame 50, and are rotatably supported so as to be vertically swingable. Further, in the side walls 50A of the belt frame 50, cylindrical protrusions 57 protruding horizontally outward can be integrally formed in positions closer to the rear end.

The body casing 2 can be formed by covering an outer surface of the body frame that is a framework with a synthetic resin outer cover, though not shown in detail. The body frame includes a pair of right and left side wall frames 58 , which can be made of insulating synthetic resin. The side wall frames 58 are adapted to support the process frame 29 including the plurality of photosensitive drums 31 in a positioned state. In the side wall frames 58, as shown in FIGS. 5 to 7, a pair of unit support portions 59 for supporting the belt unit 15 are integrally provided on the right and left of the belt unit 15.

The right and left unit support portions 59 are substantially symmetrical with each other. On the rear of the unit support portions 59, horizontal placing surfaces 60 are provided that receive the shaft receiving portions 17C that rotatably support the roller shaft 17A of the belt driving roller 17. On the outside in the width direction relative to at least one placing surface 60, an axial control surface 61 that forms a vertical plane is formed. The shaft receiving portion 17C abuts against the axial control surface 61 by a thrust force applied when the connection gear 52 is rotatably driven to position the roller body 17B in the axial direction. Further, inclined surfaces 62 with raised front ends are provided in the front of the placing surfaces 60, and in assembly of the belt unit 15, the shaft receiving portions 17C are slid along the inclined surfaces 62 from the front end toward the rear end to guide the shaft receiving portions 17C that rotatably supports the roller shaft 17A onto the placing surface 60. The unit support portions 59 have groove portions 63 that receive the protrusions 57 of the belt frame 50 on the front of the placing surfaces 60. An inner wall surface on the front of each groove portion 63 is a vertical forward control surface 63A, which abuts against the protrusion 57 of the belt frame 50 to control forward displacement of the belt frame 50.

On the front of the unit support portions 59, horizontal placing surfaces 64 are provided in the same level as the placing surfaces 60 on the rear. The placing surfaces 64 receive the shaft receiving portions 16C that rotatably support the roller shaft 16A of the belt driven roller 16 displaceably in the direction from the front to the back. In the right and left side wall frames 58, a pair of levers 66 of elongated plate shape are rotatably mounted in lower positions of the front ends of the unit support portions 59. An urging spring 67 is mounted to a lower end of each lever 66, and the urging spring 67 urges the lever 66 clockwise in FIG. 6. Upper ends of the levers 66 urge forward the shaft receiving portions 16C that rotatably support the roller shaft 16A of the belt driven roller 16 and are placed on the placing surfaces 64 to apply appropriate tension to the conveying belt 18 extended between the belt driven roller 16 and the belt driving roller 17.

In the front ends of the right and left unit support portions 59, positioning portions 68 protrude upward. The positioning portions 68 have axial control surfaces 68A that form vertical planes and are in positions axially holding therebetween the shaft receiving portions 16C of the roller shaft 16A placed on the placing surfaces 64. A distance between the axial control surfaces 68A is slightly longer than the length of the roller shaft 16A of the belt driven roller 16, and the shaft receiving portions 16C that rotatably support the roller shaft 16A is inserted between the axial control surfaces 68A to control axial displacement of the belt driven roller 16. Further, as shown in FIG. 7, guide surfaces 68B inclined toward the center in the lateral direction are formed continuously with upper ends of the axial control surfaces 68A in the positioning portions 68. In the assembly of the belt unit 15, the belt unit 15 is brought close to the unit support portions 59 from above, and the ends of the shaft receiving portions 16C that rotatably support the roller shaft 16A of the belt driven roller 16 are abutted against the guide surfaces 68B to guide the shaft receiving portions 16C in the axial direction, and insert the shaft receiving portions 16C between the pair of axial control surfaces 68A.

With such a configuration, in a state where the belt unit 15 is normally mounted to the unit support portions 59, the shaft receiving portions 17C and 16C that rotatably support the roller shafts 17A and 16A of the belt driving roller 17 and the belt driven roller 16 are placed on the placing surfaces 60 and 64, respectively, thereby vertically positioning the parts of the belt unit 15 such as the belt frame 50 and the conveying belt 18. Also, the shaft receiving portions 16C that rotatably support the roller shaft 16A of the belt driven roller 16 are urged forward by the levers 66 to apply tension to the conveying belt 18 and urge the belt frame 50 forward, and the protrusions 57 abut against the forward control surfaces 63A of the groove portion 63. Thus, the belt frame 50 is positioned in the direction from the front to the back, and the belt driving roller 17, the transfer rollers 19 and the backup roller 22 are thus positioned in the direction from the front to the back.

Further, in a state where the shaft receiving portion 17C of the belt driving roller 17 is inserted to face the axial control surface 61, the shaft receiving portion 17C abuts against the axial control surface 61 by the thrust force generated by the rotatable driving of the connection gear 52 to position the belt driving roller 17 in the axial direction and thus position the belt frame 50, the transfer rollers 19 and the backup roller 22 in the lateral direction (the width direction of the conveying belt 18). The roller shaft 16A of the belt driven roller 16 is inserted between the pair of axial control surfaces 68A to position the belt driven roller 16 in the axial direction and thus position the conveying belt 18 in the width direction.

As described above, according to the aspect, the belt driven roller 16 having the belt guide 55 that positions the conveying belt 18 in the width direction is supported displaceably in the axial direction relative to the belt frame 50, and positioned in the axial direction relative to the body casing 2 independently of the belt driving roller 17 and the belt frame 50. Thus, the belt driven roller 16 is directly positioned relative to the body casing 2, thereby increasing positional accuracy of the conveying belt 18 in the width direction relative to the body casing 2. The belt driven roller 16 is displaceable in the axial direction relative to the belt frame 50, and even if the belt driven roller 16 and the belt driving roller 17 are positioned in the axial direction relative to the body casing 2, the dimensional tolerance between the belt driven roller 16 and the belt driving roller 17 reduces or eliminates distortion in the belt frame 50 positioned integrally with the belt driving roller 17. This can also increase the positional accuracy of the transfer rollers 19 and result in a more stable image quality to be obtained.

The belt driving roller 17 and the belt driven roller 16 are positioned by the common member (the side wall frame 58), thereby increasing positional accuracy between the belt driving roller 17, the belt frame 50 and the transfer rollers 19, and between the belt driven roller 16 and the conveying belt 18.

Further, the belt driven roller 16 and the process frame 29 including the plurality of photosensitive drums 31 are positioned by the common member (the side wall frame 58), thereby further increasing positional accuracy between the conveying belt 18 and the photosensitive drums 31.

The belt driven roller 16 is positioned in the axial direction by being held between the pair of axial control surfaces 68A. The insertion of the belt driven roller 16 between the pair of axial control surfaces 68A is guided in the axial direction by the guide surfaces 68B, thereby allowing smooth mounting of the belt unit 15.

In the above configurations, the direct transfer type image forming apparatus including the belt unit having the conveying belt for conveying the recorded medium has been illustrated, but the present invention may be applied to an intermediate transfer type image forming apparatus including a belt unit having an intermediate transfer belt.

In the above configurations, the roller shafts of the belt driven roller and the belt driving roller are indirectly positioned via the shaft receiving portions, but according to the present invention, the roller shafts may be directly positioned.

In the above configurations, the belt guide is provided in the belt driven roller only, but according to the present invention, belt guides may be provided in both the belt driven roller and the belt driving roller.

In the above configurations, the belt driven roller is urged by the lever and the urging spring provided in the apparatus body to apply tension to the belt, but according to the present invention, tension applying means for urging a belt driven roller to apply tension to a belt may be provided in a belt unit, or tension applying means for urging a roller separate from a belt driven roller to apply tension to a belt may be provided.

In the above configurations, the shaft receiving portions that rotatably support the belt driven roller are held between the pair of right and left axial control surfaces to position the roller in the axial direction, but according to the present invention, for example, an axial control surface may be provided on one side only as in the belt driving roller, and an end of a roller shaft may be abutted against the axial control surface using urging means or the like to position the roller. The belt driving roller may be held between a pair of axial control surfaces to position the roller in the axial direction as in the belt driven roller.

What is claimed is:

1. An image forming apparatus comprising:

an apparatus body; and a belt unit detachably attached to said apparatus body, wherein said belt unit includes:

a belt having an engaging portion;

a belt frame;

a belt driving roller that is positioned in an axial direction and supported by said belt frame, the belt driving roller structured to receive said belt, and is rotatably driven to move said belt;

a belt driven roller that is supported displaceably in the axial direction by said belt frame, the belt driven roller structured to receive said belt, wherein the belt driven roller includes a belt guide that engages said engaging portion to position said belt in a width direction, and is rotated by the circulating movement of said belt; and a transfer member held by said belt frame, and wherein said apparatus body includes:

a driving roller axial positioning portion that positions said belt driving roller in the axial direction; and a driven roller axial positioning portion that positions said belt driven roller in the axial direction.

2. The image forming apparatus according to claim 1, wherein said driving roller axial positioning portion and said driven roller axial positioning portion are connected by a common member.

3. The image forming apparatus according to claim 2, wherein said driven roller axial positioning portion has a pair of positioning surfaces and a guide surface, wherein said pair of positioning surfaces are placed to face each other and to position the belt driven roller between the pair of positioning surfaces in the axial direction, and wherein said guide surface is structured to guide insertion of said belt driven roller between said pair of positioning surfaces in the axial direction.

4. The image forming apparatus according to claim 2, wherein said apparatus body comprises an image bearing member positioned to face said transfer member, said belt is sandwiched between said image bearing member and said transfer member, and said driven roller axial positioning portion and a member for positioning an image bearing member unit having said image bearing member are connected by a common member.

5. The image forming apparatus according to claim 4, wherein said driven roller axial positioning portion has a pair of positioning surfaces and a guide surface, wherein said pair of positioning surfaces are placed to face each other and to position the belt driven roller between the pair of positioning surfaces in the axial direction, and wherein said guide surface is structured to guide insertion of said belt driven roller between said pair of positioning surfaces in the axial direction.

6. The image forming apparatus according to claim 1, wherein said apparatus body comprises an image bearing member positioned to face said transfer member, said belt is sandwiched between said image bearing member and said transfer member, and said driven roller axial positioning portion and a member for positioning an image bearing member unit having said image bearing member are connected by a common member.

7. The image forming apparatus according to claim 6, wherein said driven roller axial positioning portion has a pair of positioning surfaces and a guide surface, wherein said pair of positioning surfaces are placed to face each other and to position the belt driven roller between the pair of positioning surfaces in the axial direction, and wherein said guide surface is structured to guide insertion of said belt driven roller between said pair of positioning surfaces in the axial direction.

8. The image forming apparatus according to claim 1, wherein said driven roller axial positioning portion has a pair of positioning surfaces and a guide surface, wherein said pair of positioning surfaces are placed to face each other and to position the belt driven roller between the pair of positioning surfaces in the axial direction, and wherein said guide surface is structured to guide insertion of said belt driven roller between said pair of positioning surfaces in the axial direction.

9. An image forming apparatus comprising:

an apparatus body; and a belt unit detachably attached to said apparatus body, wherein said belt unit includes:

a belt having an engaging portion;

a belt frame;

a belt driving roller that is positioned and supported by the belt frame, wherein the belt driving roller contacts the belt and is capable of being driven to move said belt;

a belt driven roller that is supported displaceably in the axial direction by the belt frame, the belt driven roller contacts the belt, wherein the belt driven roller includes a belt guide that contacts said engaging portion to position said belt in a width direction, and is rotated by movement of said belt;

wherein said apparatus body includes:

a driving roller axial positioning portion that positions said belt driving roller in the axial direction; and a driven roller axial positioning portion that positions said belt driven roller in the axial direction.

10. The image forming apparatus according to claim 9, wherein said driving roller axial positioning portion and said driven roller axial positioning portion are connected by a common member.

11. The image forming apparatus according to claim 9, wherein said apparatus body comprises an image bearing member positioned to face a transfer member, wherein said belt is sandwiched between said image bearing member and said transfer member, and wherein said driven roller axial positioning portion and a member for positioning an image bearing member unit having said image bearing member are connected by a common member.

12. The image forming apparatus according to claim 9, wherein said driven roller axial positioning portion has a pair of positioning surfaces and a guide surface, wherein said pair of positioning surfaces are placed to face each other and to position the belt driven roller between the pair of positioning surfaces in the axial direction, and wherein said guide surface is structured to guide insertion of said belt driven roller between said pair of positioning surfaces in the axial direction.

* * * * *